United States Patent [19]

Mourier

[11] Patent Number: 4,585,965

[45] Date of Patent: Apr. 29, 1986

[54] RADIO ELECTRIC WAVE GENERATOR FOR ULTRA-HIGH FREQUENCIES

[75] Inventor: Georges Mourier, Le Port, France

[73] Assignee: Thomson-CSF, Paris, France

[21] Appl. No.: 595,976

[22] Filed: Apr. 2, 1984

[30] Foreign Application Priority Data

Apr. 6, 1983 [FR] France ..... 83 05602

[51] Int. Cl.[4] ..... H01J 25/34

[52] U.S. Cl. ..... 315/39.3; 315/3.6; 315/5.33; 315/39.51

[58] Field of Search ..... 315/39.3, 510, 5.33, 315/3.6, 5.34

[56] References Cited

U.S. PATENT DOCUMENTS

| | | | |
|---|---|---|---|
| 2,744,913 | 12/1956 | Charles | 315/39.3 |
| 3,189,785 | 6/1965 | Kluver | 315/39.3 |
| 3,249,792 | 7/1962 | Pantell | 315/5.0 |
| 3,271,618 | 9/1966 | Kooyers | 315/39.3 |
| 3,378,718 | 4/1966 | Osepchuk | 315/3.5 |
| 4,087,718 | 5/1978 | Farney | 315/39.3 |
| 4,207,495 | 6/1980 | McDowell | 315/39.3 |

FOREIGN PATENT DOCUMENTS 2025126 6/1978 United Kingdom .

*Primary Examiner*—Harold Dixon

*Attorney, Agent, or Firm*—Roland Plottel

[57] ABSTRACT

A generator is provided based on an interaction of the cyclotronic type between an electron beam propagating between an electron gun and a collector and a high frequency electromagnetic field in a resonating structure. It is principally characterized in that the electron beam moves along a cycloidal path in a transverse magnetic field under the effect of a drift velocity created by a continuous electric field.

7 Claims, 4 Drawing Figures

RADIO ELECTRIC WAVE GENERATOR FOR ULTRA-HIGH FREQUENCIES

BACKGROUND OF THE INVENTION

1. Field of the Invention

The present invention relates to a wave generator for ultra-high frequencies, more particularly a millimetric and sub-millimetric wave generator of the cyclotronic resonance maser type.

2. Description of the Prior Art

As generators of this type the generators called gyrotrons are known in particular. In these generators, an electron beam coming from an electron gun propagates along helicoidal paths while being guided by a uniform magnetic field directed along the axis of the helix. The beam passes then through an electromagnetic cavity resonating at a frequency $f_o$ close to a multiple of the cyclotronic frequency, in which cavity the transverse velocity components of the electrons interact with a transverse electric field component of the wave so as to give up their energy thereto. In this case, the beam is propagated substantially parallel to the magnetic field. Since the interaction takes place with the transverse velocity component $v\perp$ of the electrons, the parallel velocity component $v\|$ corresponds then to energy unused in the interaction. Efforts are therefore in general made to limit the value of this parallel velocity. However in the generators of the above type, it is not possible to operate with low values of $v\|$, for in this case an unstable electron beam is obtained. Consequently, the values of $v\perp/v\|$ must be chosen so that $$0.5<v\perp/v\|<2$$

SUMMARY OF THE INVENTION

The aim of the present invention is therefore to remedy this drawback by providing a new generator of the cyclotronic resonance maser type in which the parallel velocity component of the electrons may be equal to zero or substantially equal to zero.

The present invention provides therefore a wave generator for ultra-high frequencies based on an interaction of the cyclotronic type between an electron beam propagating between an electron gun and a collector and a high frequency electromagnetic field in a resonating structure, wherein the electron beam moves along a cycloidal path in a transverse magnetic field under the effect of a drift velocity created by a continuous electric field.

The present invention also relates to new resonating structures and new collectors for this type of generator.

Thus, according to a preferred embodiment, the resonating structure is formed by two electrodes facing each other between which the electron beam passes transversely, the two electrodes being brought to different DC potentials and being, at least in their central part, spaced apart by a distance H, slightly greater than $n\lambda/2$, n being a whole number and $\lambda$ the wave length corresponding to the cyclotron resonance frequency.

Similarly, the collector is formed by a curved reflector brought to the potential of the upper electrode of the resonating structure and positioned as an extension of the lower electrode.

BRIEF DESCRIPTION OF THE DRAWINGS

Other features and advantages of the present invention will appear from reading the description of different embodiments made with reference to the accompanying drawings in which.

In the figures, the same elements bear the same reference numbers but for the sake of clarity the sizes and proportions are not respected.

DESCRIPTION OF THE PREFERRED EMBODIMENTS

Figure 1:
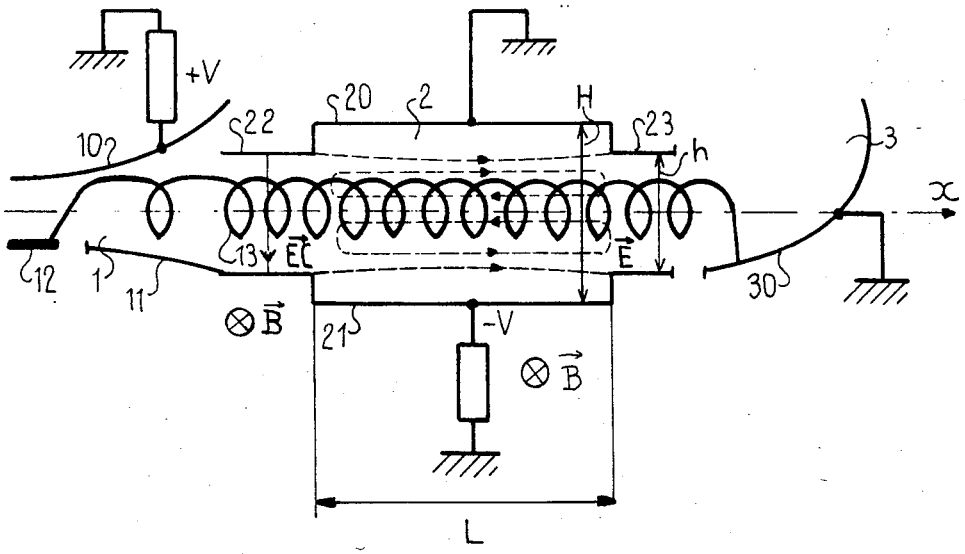
FIG. 1 is a schematical sectional view of the electron gun-resonating cavity-collector assembly of a generator in accordance with the present invention.

The embodiment of the radioelectric wave generator for ultra-high frequencies shown in FIG. 1 is formed essentially by an electron gun 1 providing an electron beam moving under the effect of a continuous electrostatic field $\overline{E}_c$, perpendicularly to a constant magnetic field $\overline{B}$ the longitudinal direction x, following a cycloidal path, a structure 2 resonating at a frequency $f_o$ equal to a multiple of the cyclotronic frequency and a collector assembly 3 for receiving and removing the electrons at the output of the resonating structure.

The electron gun 1 is an electron gun of the type described in the patent application Ser. No. 595,973 in the name of the applicant filed on the same day as the present application. It comprises essentially two electrodes which face each other, one of which, namely the anode 10 is brought to a positive potential whereas the other, namely the sole 11 is brought to a negative or zero potential and a cathode 12 brought to the potential of the sole and situated in the plane thereof. Anode 10 and sole 11 have a curved profile divergent from left to right in FIG. 1, so that the continuous electric field $\overline{E}_c$ created between the two electrodes 10, 11 decreases in this direction. When the assembly is placed in a constant magnetic field $\overline{B}$ directed perpendicularly to the plane of the figure, the electrons from the cathode move in direction x perpendicular to the magnetic field under the effect of the drift velocity due to the continuous electric field between the two electrodes 10, 11 along a cycloidal path around the longitudinal x axis.

The electron beam 13, moving with the cycloidal movement in direction x, is then fed into a resonating structure 2. This structure 2 is formed by two electrodes 20, 21 facing each other, brought to different DC potentials for providing between the electrodes a continuous electric field $\overline{E}_c$. This structure contains high frequency electromagnetic energy corresponding to an oscillation at a frequency $f_o$ close to a multiple of the cyclotron frequency $f_c$. So that the waves at frequencies $f_o$ may oscillate in the resonating structure, the distance H between the two electrodes, 20, 21 is chosen so as to be, at least in the central part of the plates, slightly greater than a whole number of half length waves. In addition, the length L of the electrodes is chosen equal to a few wave lengths, the dimension along the magnetic field $\overline{B}$ depending on the corresponding dimension of the anode which may be large with respect to the other dimensions.

Furthermore, the injection and removal of the electron beam into and out of the resonating structure 2 are provided by means of elements of the sliding tube type 22, 23 having a height h such that:

$$(n-1)\lambda/2<h<n\lambda/2 \text{ with } \lambda=c/f_o$$

so as to avoid any undesirable resonance.

Thus, the electron beam is removed from the resonating structure through tube 23 towards the collector part 3. This collector part 3 is formed of a curved reflector 30 which extends the lower electrode 21 of the resonating structure and which is brought to the potential of the upper electrode 20 of said structure. This reflector 30 collects the electromagnetic energy and radiates it in a substantially vertical direction in FIG. 1, towards a vacuum tight transparent window which has not been shown in this Figure.

As for the operation of this type of generator, it may be stated that the behavior of the electrons then is practically identical to that observed in gyrotrons. In fact, in the reference system moving at the drift velocity, the continuous electric field is suppressed by the continuous magnetic field and the high frequency electric field is not modified for it is longitudinal to the displacement speed. Thus, by using Lorentz's transformation and designating with a prime or apostrophe the magnitudes measured in the reference system, we obtain:

$$\overline{E}'_x = \overline{E}_x \text{ (high frequency field)}$$

$$\overline{E}'_y = \gamma\,[\overline{E}_y - \bar{c}_x\,\overline{B}_z] \text{ (continuous fields)}$$

$$\text{for } v_x = v_D$$

$$\text{with } \gamma = \frac{1}{\sqrt{1 - v_D^2/C^2}}$$

However, there exists a transformation of the magnetic fields $$\overline{B}'_z = \gamma\left[\overline{B}_z - \frac{\overline{V}_D}{C^2}\,\overline{E}_y\right] = \gamma\overline{B}_z\left(1 - \frac{\overline{V}_D^2}{C^2}\right) = \overline{B}_z\sqrt{1 - \frac{V_D^2}{C^2}}$$

This transformation will then cause a correction of the value of the magnetic field required for optimum interaction. However, the value of this correction remains low.

Figure 2:
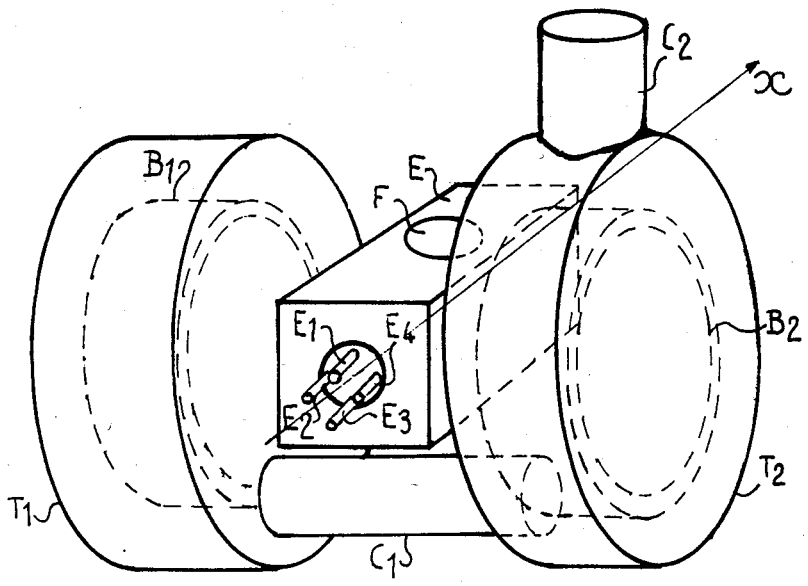
FIG. 2 is a perspective view of the assembly of the generator of FIG. 1.

Furthermore, as shown in FIG. 2, the magnetic field $\overline{B}$ is obtained by means of two superconducting coils $B_1$ and $B_2$ disposed according to Helmholz's rule and situated inside two drums $T_1$ and $T_2$ filled with liquid helium. The two drums $T_1$ and $T_2$ are connected together by a hollow tube $C_1$ which also contains the electric connections between the two coils. The assembly is fed with liquid helium and electric current through a tube $C_2$.

The electron gun-resonating structure-collector assembly described above with reference to FIG. 1 is contained in a metal enclosure E. This enclosure comprises, in the embodiment shown, four insulated outputs $E_1,E_2,E_3,E_4$ connected respectively to the cathode, to its heating element, to the anode and possibly to the sole or to the negative part of the resonating structure. On the upper part of the enclosure is provided the transparent window F, preferably circular, for outputting the radiation.

Enclosure E is placed between the two drums $T_1$ and $T_2$ so that the electron beam is propagated parallel to the drums, namely in direction x.

Figure 3:
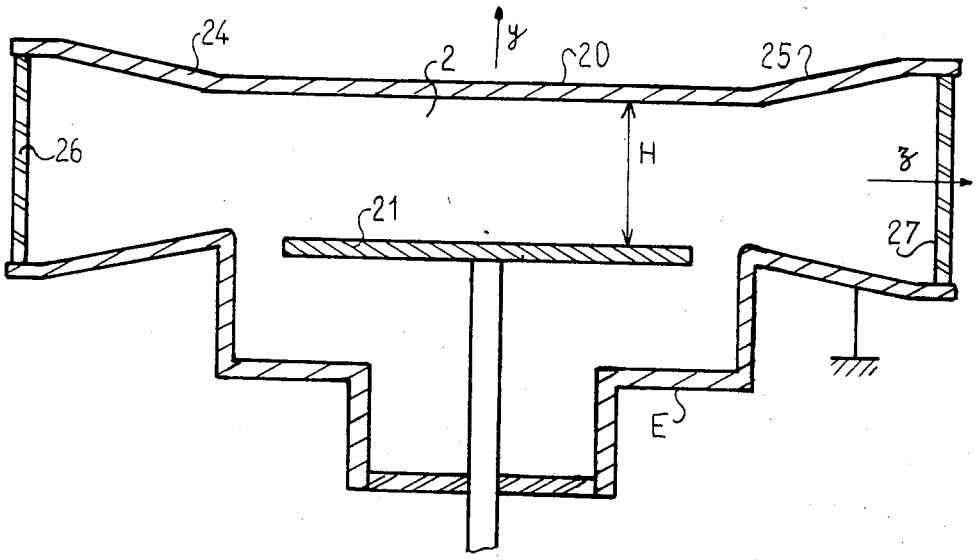
FIG. 3 is a schematical sectional view of input and output devices of the wave to be amplified when the generator of FIG. 1 is used as an amplifier.

The modifications to be made to the above described embodiment so as to use it as an amplifier will now be described with reference to FIGS. 3 and 4. FIG. 3 shows schematically a section parallel to the plane zoy in the median part of the resonating structure 2, illustrating a particular embodiment of the input and output circuits for the signal to be treated. As in the embodiment of FIG. 1, the electron beam propagates in direction x with a drift velocity $V_D$ and orbits with axis z between the two electrodes 20, 21 which contain the electromagnetic energy.

In the embodiment shown in FIG. 3, electrode 21 is moveable, which allows the height H to be adjusted depending on the oscillation frequency $f_o$ so that:

$$H \gtrsim n\lambda/2 \text{ with } \lambda=c/f_o$$

However, in the embodiment shown in FIG. 3, the electromagnetic energy is transported in direction z in the form of a travelling wave excited in the desired mode by an external high frequency source. This wave passes through the input window 26 then is matched to the impedance of the resonating cavity formed by the two electrodes 20, 21 by means of horn 24. The amplified wave is then fed into a guide, not shown, leading for example to an antenna, through a horn 25 and a window 27. In this case, the collector 3 is formed by a reflector closed at the upper part of the resonating structure.

The above described amplifier has the disadvantage of being reciprocal with respect to the input and the output that is to say that it is electrically symmetrical with respect to the direction of propagation and also amplifies the signals reflected towards the input of the tube because of matching which is always imperfect in the output guide.

Figure 4:
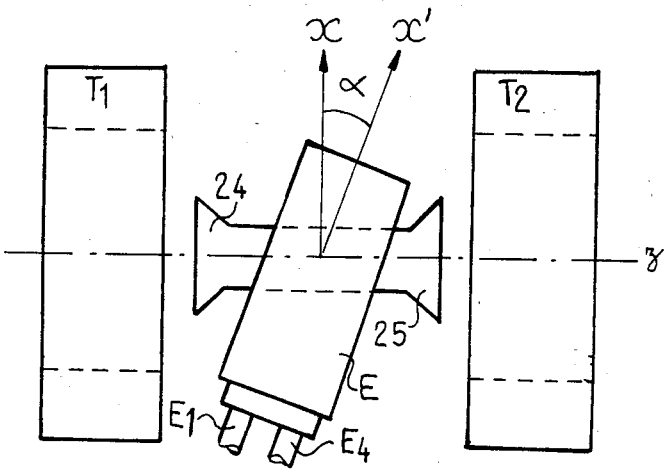
FIG. 4 is a schematical top view of another embodiment of the amplifier.

FIG. 4 shows an embodiment for overcoming this drawback.

In this embodiment, electrodes 20 and 21 are offset by an angle $\alpha$ with respect to direction x so that the electrons accelerated by the gun in direction x' have also a drift component in direction z equal to $v_D \sin \alpha$. Since the electromagnetic field remains uniform in direction x but varies in phase according to an expression of the type $\cos(\omega t - kz + \phi)$, the resonance condition is no longer given by:

$$f_o \approx l f_c$$

but by $$f_o - kVd/2\pi \approx l f_c$$

(l being the order of the harmonic of the cyclotronic frequency which interacts).

It follows from this latter equation that the resonance depends on the sing of k, i.e. on the propagation direction and that said equation, which must be fulfilled for amplification to take place, will favor one of the propagation directions.

In the above described embodiments, the electrodes are made preferably from copper and the windows from a dielectric material.

The generators according to the present invention operate like a gyrotron, and have then the same applications as the generators of the prior art for millimetric waves. They may be used in particular for heating in plasma installations, radar transmission, telecommunications, etc.

What is claimed is:

1. A wave generator for ultra-high frequencies based on an interaction of the cyclotronic type between an electron beam propagating between an election gun and a collector and a high frequency electromagnetic field in a resonating structure through which the beam flows, said electron beam, moving along a cycloidal path essentially about a longitudinal axis in a transverse magnetic field under the effect of a drift velocity created by a continuous electric field characterized in that the resonating structure comprises first and second opposed planar electrodes defining a passage therebetween through which the electron beam traverses, the two electrodes adapted to be operated at different potentials and being in at least their central positions spaced apart by a distance H slightly greater than $n\lambda/2$ where n is a whole number and $\lambda$ the wavelength of the resonant frequency of said resonating structure.

2. A generator of ultra-high frequency waves based on interaction of the cyclotronic type between an electron beam propagating between an electron gun and a collector in a transverse magnetic field and a high frequency electromagnetic field in a resonating structure, said electron beam moving in a cycloidal path essentially along a longitudinal axis under the effect of a drift velocity created by a continuous electric field wherein the resonating structure comprises a pair of parallel plate electrodes facing one another on opposite sides of the electron beam path, the plate electrodes being spaced apart a distance slightly more than an integral number of half wavelengths of the desired operating frequency and extending along the path a few wavelengths of the operating frequency and adapted to be maintained at different d-c potentials.

3. A generator in accordance with claim 2 in which said first and second plate electrodes are substantially planar and the collector electrode is a curved plate positioned to be a separate curved extension of the said first plate electrode but adapted to be maintained at the potential of said second plate electrode.

4. A generator in accordance with claim 2 for use as a signal wave amplifier which further includes input coupling means and output coupling means aligned on opposite sides of said resonating structure for injecting and abstracting the signal wave along a direction parallel to the transverse magnetic field.

5. A signal amplified in accordance with the amplifier of claim 4 in which the alignment of the input and output coupling means is oriented with respect to the axis of the electron beam such that the amplification is non-reciprocal with respect to signal energy reflected by the output coupling means back towards the input coupling means.

6. A generator for ultra-high frequencies based on an interaction of the cyclotronic type between an electron beam propagating between an electron gun and a high frequency electromagnetic field in a resonating structure, wherein said electron beam moves along a cycloidal path in a transverse magnetic field under the effect of a drift velocity created by a continuous magnetic field in which the resonating structure is formed by two electrodes facing each other and between which the electron beam passes transversely, the two electrodes being brought to different d-e potentials and being, at least in their central part, spaced apart by a distance slightly greater than an integral number of half wavelengths of the resonance frequency and wherein the input and output points for the electron beam in the resonating structure are formed by extensions of said electrodes which are spaced apart a distance which is less than the spacing of said electrodes by less than one-half a wavelength of the resonance frequency.

7. A wave generator in accordance with claim 6 in which the collector is a curved electrode adapted to be maintained at the potential of the electrode of higher potential and oriented to be a separate extension of the electrode of lower potential.

* * * * *